US005143352A

United States Patent [19]

Latimer

[11] Patent Number: 5,143,352

[45] Date of Patent: Sep. 1, 1992

[54] SNOWMOBILE LIFT APPARATUS

[76] Inventor: Donald R. Latimer, 1714 Pine La., Delta Junction, Ak. 99737

[21] Appl. No.: 541,320

[22] Filed: Jun. 21, 1990

[51] Int. Cl.[5] ..... B66F 3/00

[52] U.S. Cl. ..... 254/131

[58] Field of Search ..... 254/120, 129, 130, 131, 254/133, 134, 30, 31; 248/167, 188.7, 188.8

[56] References Cited

U.S. PATENT DOCUMENTS

| | | | |
|---|---|---|---|
| 1,511,802 | 10/1924 | Combs et al. | 254/120 |
| 1,773,237 | 8/1930 | Naujoks et al. | 248/167 |
| 1,807,142 | 5/1931 | Achenbach | 254/119 |
| 3,907,254 | 9/1975 | Richards | 254/131 |
| 3,964,729 | 6/1976 | Harlow | 254/131 |
| 4,214,724 | 7/1980 | Geiger | 248/167 |
| 4,867,416 | 9/1989 | Garrett et al. | 254/93 R |
| 5,000,423 | 3/1991 | Snickers | 254/131 |

*Primary Examiner*—Robert C. Watson
*Attorney, Agent, or Firm*—Leon Gilden

[57] ABSTRACT

Apparatus for a lifting and positioning of a snowmobile particularly during a warmup procedure of a snowmobile to vertically space a snowmobile drive surface above an associated ground level wherein the apparatus includes a central post mounted to a socket wherein the socket is orthogonally and fixedly mounted to a top support leg with a bottom support leg pivotally mounted to the top support leg with an abutment plate mounted to support post remote from the socket. The apparatus includes a first link and a first link axle received within one of plurality of axle apertures mounted within the post.

The first link includes a series of first link apertures to receive a second link pivot axle orthogonally mounted to a second link wherein the second link includes a bifurcated lift plate securable to a bumper portion of an associated snowmobile. Modifications of the invention include a hydraulic jack support clip and hydraulic jack to provide fixed support for the snowmobile subsequent to a lifting procedure wherein further the apparatus may include stabilizer legs pivotally and telescopingly mounted to sides of the support post.

2 Claims, 5 Drawing Sheets

PRIOR ART 17
12b
18
19
23
21
20
22
24
25
34
33
31
38
38
26
37
35
30
29
15
16
13
14
16

SNOWMOBILE LIFT APPARATUS

BACKGROUND OF THE INVENTION

1. Field of the Invention

The field of the invention relates to lifting apparatus, and more particularly pertains to a new and improved snowmobile lift apparatus wherein the same permits convenient and effective lifting of a snowmobile to permit warming of a snowmobile drive tread prior to its use.

2. Description of the Prior Art

During initial starting of a snowmobile for operation over various snow and frozen ground conditions, it is desirable to initially lift a snowmobile drive belt relative to such surface conditions prior to traverse of the snowmobile over such various terrain to minimize and prevent premature erosion and (burning) of a snowmobile drive belt.

Various lifting apparatus has been set forth in the prior art to effect lifting of various articles and examples of such may be found in the prior art exemplified by U.S. Pat. No. 4,738,433 to HOFF wherein a post puller apparatus is provided with a link mounted to a top bifurcated post wherein the link includes a forward bifurcated leg to receive a link therewithin and wherein the link includes spaced legs to encompass a post to effect lifting thereof.

U.S. Pat. No. 4,161,310 to PARKER similarly provides an enclosed loop positionable about a post wherein the loop is mounted to a lever pivotally mounted to a top end of a post to effect a lifting of a fence post and removal of the fence post from an in-ground orientation.

U.S. Pat. No. 4,365,786 to OSTEEN sets forth a moving and positioning tool wherein a pivot link is pivotally mounted to a upper end of a support post that in turn is telescopingly mounted to a tripod arrangement.

U.S. Pat. No. 1,133,391 to MORRISON sets forth a jack arrangement wherein moving sleeve portions are provided to effect elevation of various construction components.

U.S. Pat. No. 2,341,106 to KUZELA sets forth a post puller utilizing a link member that is cooperative with a rack arrangement to effect a lifting of a plate that in turn is secured to a post to be lifted from a within ground condition.

As such, it may be appreciated that there continues to be a need for a new and improved snowmobile lift apparatus wherein the same conveniently and efficiently permits lifting of a snowmobile to space a snowmobile drive belt relative to an associated support surface and in this respect, the present invention substantially fulfills this need.

SUMMARY OF THE INVENTION

In view of the foregoing disadvantages inherent in the known types of lift apparatus present in the prior art, the present invention provides a new and improved snowmobile lift apparatus wherein the same is arranged to permit immediate and effective lifting of a snowmobile relative to an associated support surface while conveniently arranged to effect compacting of the organization during periods of non-use. As such, the general purpose of the present invention, which will be described subsequently in greater detail, is to provide a new and improved snowmobile lift apparatus which has all the advantages of the prior art lift apparatus and none of the disadvantages.

To attain this, the snowmobile lift apparatus of the invention includes apparatus for a lifting and positioning of a snowmobile particularly during a warmup procedure of a snowmobile to vertically space a snowmobile drive surface above an associated ground level wherein the apparatus includes a central post mounted to a socket wherein the socket is orthogonally and fixedly mounted to a top support leg with a bottom support leg pivotally mounted to the top support leg with an abutment plate mounted to support post remote from the socket. The apparatus includes a first link and a first link axle received within one of plurality of axle apertures mounted within the post. The first link includes a series of first link apertures to receive a second link pivot axle orthogonally mounted to a second link wherein the second link includes a bifurcated lift plate securable to a bumper portion of an associated snowmobile. Modifications of the invention include a hydraulic jack support clip and hydraulic jack to provide fixed support for the snowmobile subsequent to a lifting procedure wherein further the apparatus may include stabilizer legs pivotally and telescopingly mounted to sides of the support post.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved snowmobile lift apparatus which has all the advantages of the prior art lift apparatus and none of the disadvantages.

It is another object of the present invention to provide a new and improved snowmobile lift apparatus which may be easily and efficiently manufactured and marketed.

It is a further object of the present invention to provide a new and improved snowmobile lift apparatus which is of a durable and reliable construction.

An even further object of the present invention is to provide a new and improved snowmobile lift apparatus which is susceptible of a low cost of manufacture with regard to both materials and labor, and which accordingly is then susceptible of low prices of sale to the consuming public, thereby making such snowmobile lift apparatus economically available to the buying public.

Still yet another object of the present invention is to provide a new and improved snowmobile lift apparatus which provides in the apparatuses and methods of the prior art some of the advantages thereof, while simultaneously overcoming some of the disadvantages normally associated therewith.

Still another object of the present invention is to provide a new and improved snowmobile lift apparatus which may be compactly stored when not being utilized.

Yet another object of the present invention is to provide a new and improved snowmobile lift apparatus wherein the same is arranged to engage a rear structural component of an associated snowmobile and effect lifting of the snowmobile to permit initial warmup of the snowmobile during use and wherein the apparatus provides a stable and effective structure to permit operation of the snowmobile during its mounting to the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
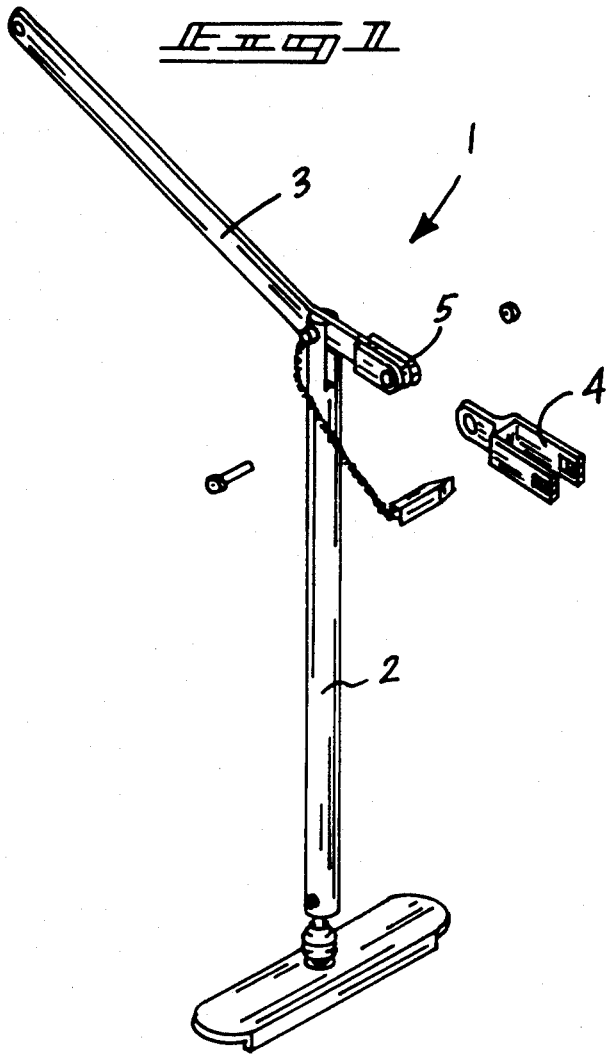
FIG. 1 is an isometric illustration of a prior art lifting device.

With reference now to the drawings, and in particular to FIGS. 1 to 9 thereof, a new and improved snowmobile lift apparatus embodying the principles and concepts of the present invention and generally designated by the reference numeral 10 will be described.

Figure 2:
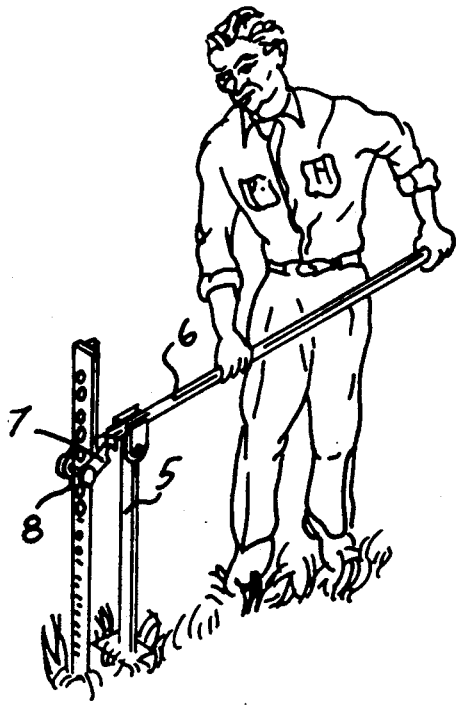
PRIOR ART FIG 2
FIG. 2 is an isometric illustration of a further prior art lifting device.

FIG. 1 illustrates a prior art lift apparatus 1 wherein a support post 2 pivotally mounts a pivot link 3 at its upper bifurcated end wherein a cleavis joint 5 mounts a U-shaped strap 4 to encompass a fence post for a lifting procedure. FIG. 2 similarly illustrates a further prior art lifting organization wherein the support post 5 utilizes a single link 6 pivotally mounted at an upper end of the post wherein a U-shaped strap utilizes an enclosure link 8 to encompass a fence post to effect lifting of the post from an in-ground orientation.

Figure 3:
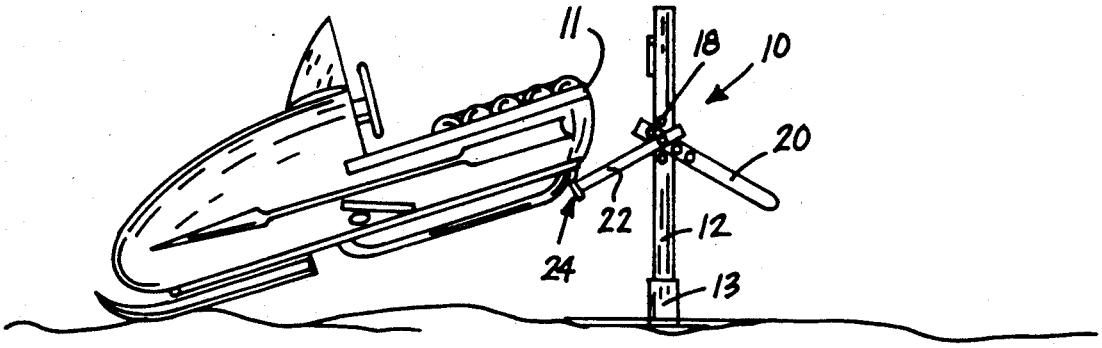
FIG. 3 is an orthographic side view of the instant invention in a lifting arrangement with an associated snowmobile.
Figure 4:
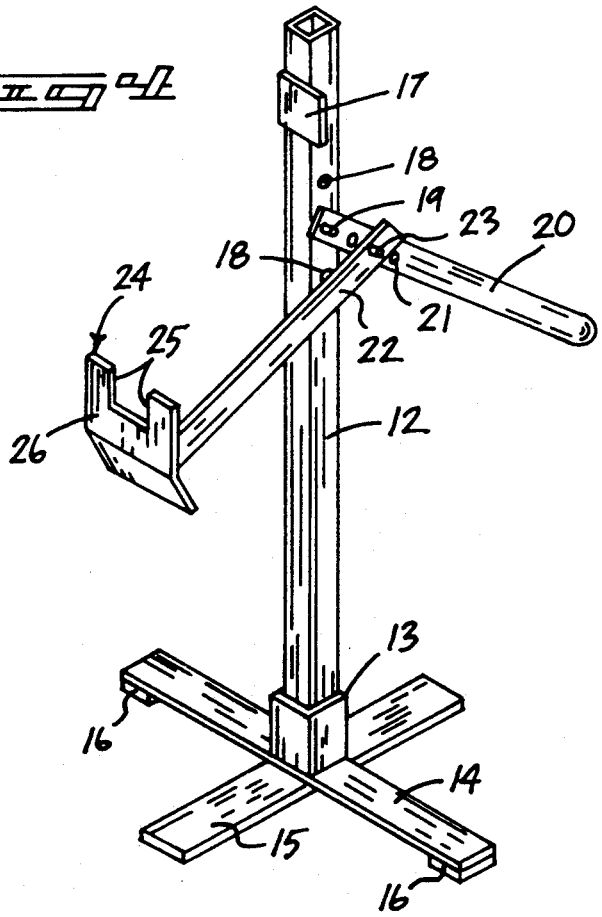
FIG. 4 is an isometric illustration of the instant invention.
Figure 5:
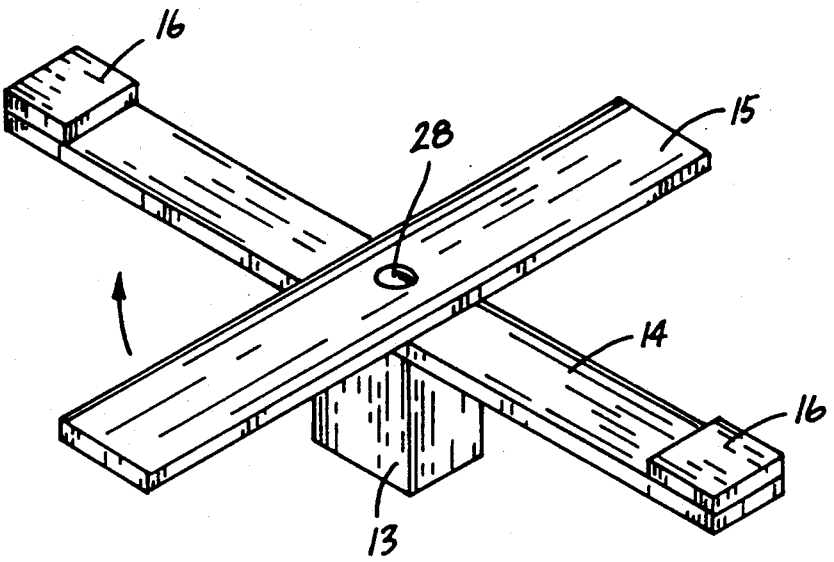
FIG. 5 is an isometric bottom view of the support members of the instant invention.

More specifically, the snowmobile lift apparatus 10 of the instant invention essentially comprises an organization to lift a snowmobile 11 in a manner as illustrated in FIG. 3 to permit a pre-warming of the snowmobile and operation of the drive belt of the associated snowmobile prior to traverse of the snowmobile about various terrain. The apparatus includes a longitudinally aligned support post 12 of polygonal crosssectional configuration selectively receivable within a support post socket 13. The support post socket 13 is orthogonally mounted to a top surface of a top support leg 14 that pivotally mounts a bottom support leg 15 between pair of support bosses 16 each of a predetermined thickness substantially equal to the predetermined thickness of the bottom leg 15 to permit reception of the bottom leg 15 in alignment between the support bosses 16 (see FIG. 5). The support post 12 includes a planar abutment plate 17 directed forwardly of a forward surface of the support post to accommodate the snowmobile structure 11 and provide an abutment surface therefore wherein the abutment plate 17 extends laterally beyond the support post.

The support post further includes an aligned series of axle apertures 18 (see FIGS. 4 and 9) for example that are orthogonally directed through the support post to receive a first link pivot axle 19 of an associated first link 20. The first link pivot axle 19 is orthogonally mounted integrally adjacent a forward end of the first link 20 spaced from a rear handle end as illustrated. A series of first link apertures 21 are orthogonally directed through the first link 20 adjacent the first link pivot axle 19 to selectively receive a second link pivot axle 23 orthogonally mounted to a second link 22. The selection of axle apertures 18 and the first link apertures 21 permit various fulcruming and orientations of the first and second links relative to one another to permit efficient and effective lifting of a variety of snowmobile structures.

A bifurcated lift plate 24 is integrally mounted to a forward terminal end of the second link 22 remote from the second link pivot axle 23 that is mounted adjacent a rear terminal end of the second link 22. The lift plate 24 includes spaced parallel legs 25 arranged to secure a structural upper component of the snowmobile 11 and wherein the spaced legs 25 are an integral component of a top plate 26 that is arranged at an obtuse angle relative to a bottom plate 27 that in turn is integrally and fixedly mounted to the forward terminal end of the second link 22. The rearwardly directed top plate 26 accordingly enhances engagement of the snowmobile structure 11 by providing a rearwardly directed hook type structure.

In storage of the organization, the top support leg 14 pivotally receives the bottom support leg 15 about a top support leg pivot axle 28 wherein the bottom support leg 15 is in alignment with the top support leg 14 in a sorted orientation with the support post 12 removed from the associated socket 13 and the first and second links 20 and 22 separated and removed from the post to permit secure and convenient storage of the organization.

Figure 6:
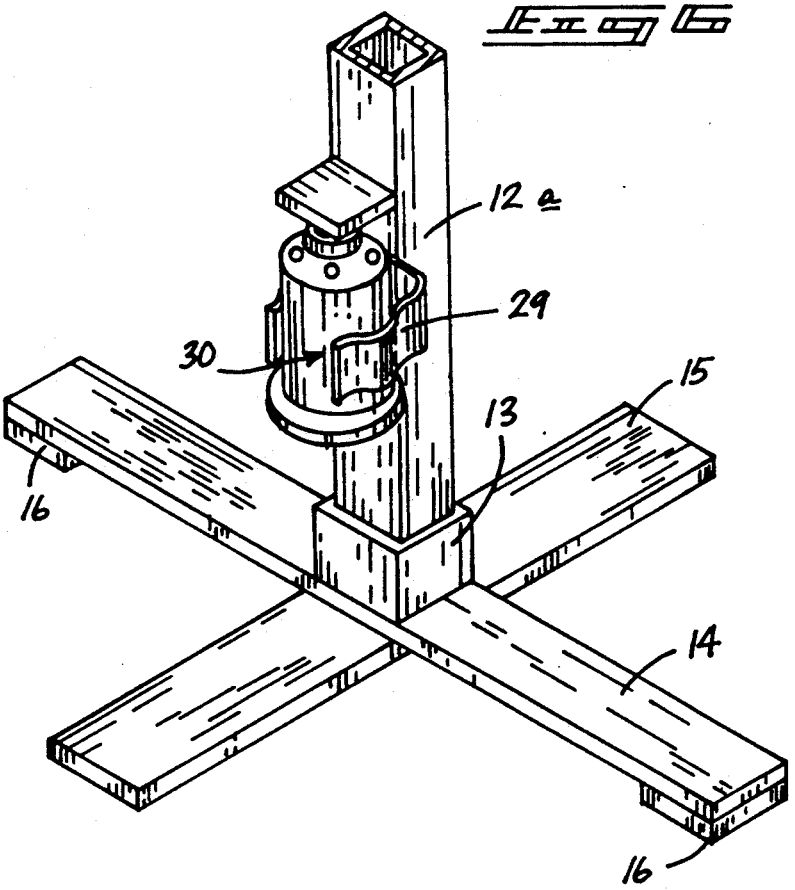
FIG. 6 is an isometric illustration of a modified support post of the instant invention.
Figure 7:
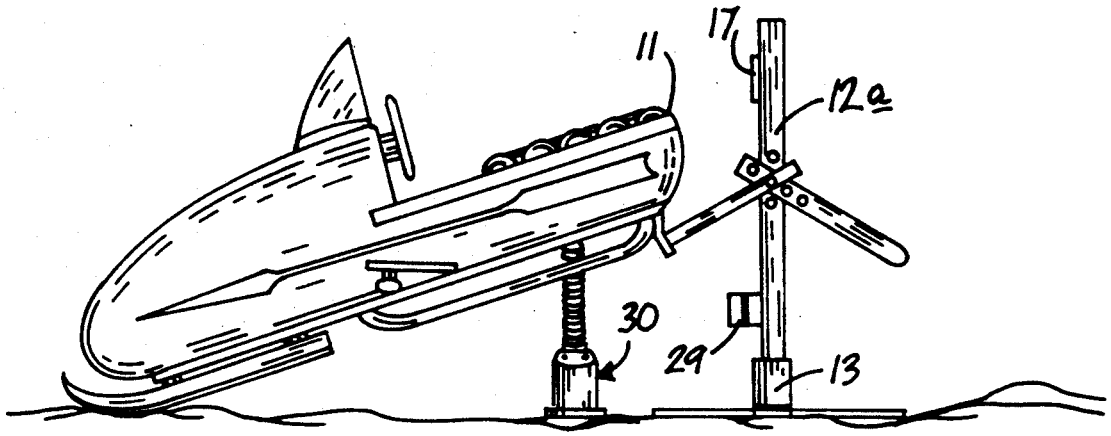
FIG. 7 is an orthographic side view taken in elevation of the modified support post in association with a jack member utilized by the instant invention.

FIGS. 6 and 7 illustrate a modified support post 12*a* utilizing a U-shaped spring clip 29 fixedly mounted to a forward face of support post 12*a* underlying the abutment plate 17 and above the lower terminal end of the support post to permit the support post to be received within the socket 13. The U-shaped spring clip 29 receives a hydraulic jack 30 therewithin to provide convenient storage of the jack structure to permit the jack structure to extend to support the snowmobile structure 11 as illustrated in FIG. 7 and enhance stability of the organization in use.

Figure 8:
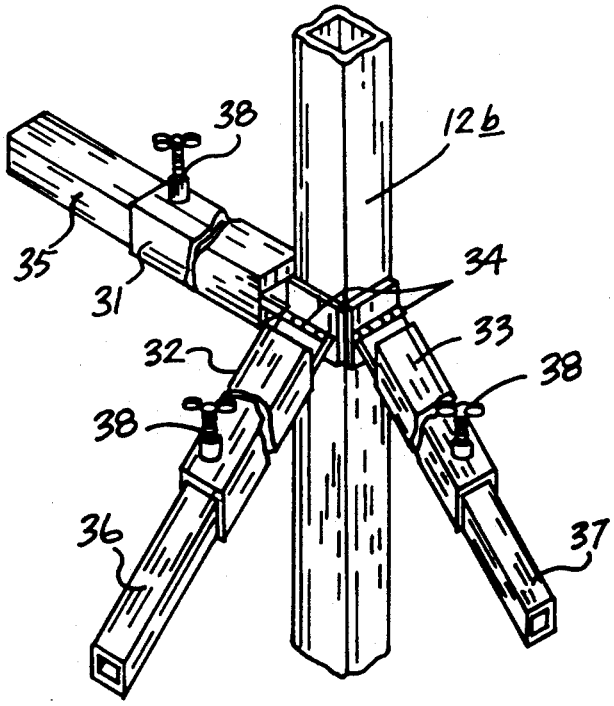
FIG. 8 is an isometric illustration of a further modified support post of the instant invention utilizing stabilizer legs.
Figure 9:
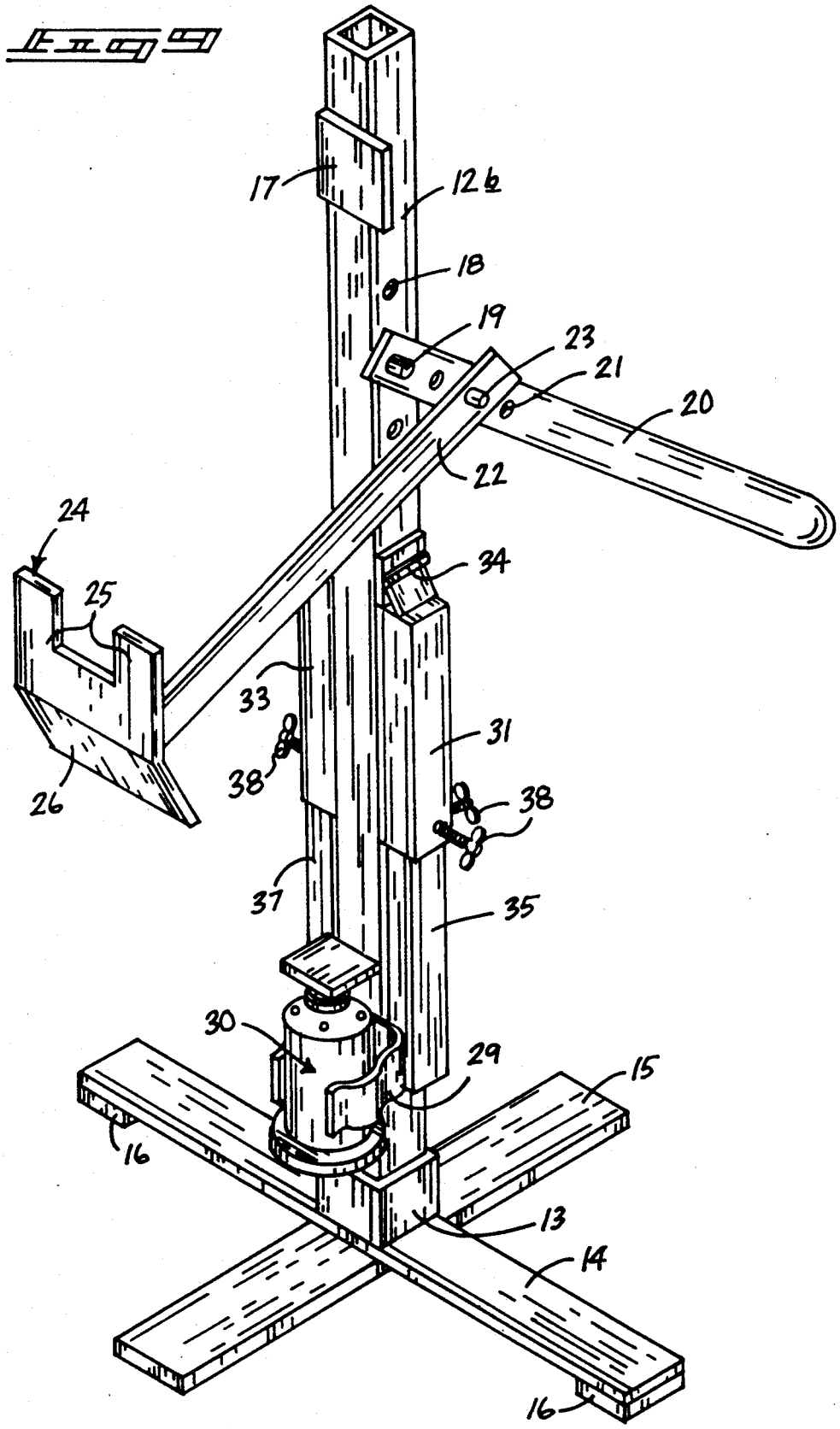
FIG. 9 is an isometric illustration of the further modified post and lift apparatus of the instant invention.

FIGS. 8 and 9 illustrate a further modified support post 12*b* wherein first, second, and third support sleeve 31, 32, and 33 respectively are mounted to side and rear faces of support post 12*a* rearwardly and laterally of the associated abutment plate 17 and the U-shaped spring clip 29 wherein each support sleeve 31 telescopingly receives a respective stabilizer rod defined by a first, second, and third stabilizer rod 35, 36, and 37 respectively that are secured in a retracted first position or extended to a second position by a clamp 38 that is rotatably mounted through each respective support sleeve to frictionally engage an associated stabilizer rod to provide a tripod arrangement to enhance stability of the organization during a lifting procedure relative to an associated snowmobile 11.

Each support sleeve includes a support sleeve hinge 34 to hingedly mount each support sleeve at its rear terminal end to the respective sides and rear face of the support post 12*b*.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A lifting apparatus comprising in combination, an elongate longitudinally aligned support post, the support post including an upper terminal end and a lower terminal end, and a base member, the base member including a socket, the socket complementarily receiving the lower terminal end of the support post selectively therewithin, the socket integrally and orthogonally mounted to a top surface of a top support leg, and the top support leg pivotally mounting a bottom support leg underlying the top support leg with a top support leg pivot axle directed medially through the bottom support leg and a top support leg, and the support post including a series of aligned axle apertures directed orthogonally through a side surface of the support post, and a first link including a first link pivot axle wherein the first link pivot axle is selectively receivable within one of the series of axle apertures, and the first link pivot axle orthogonally and integrally mounted adjacent a forward terminal end of the first link, and a second link pivotally mounted to the first link adjacent a rear terminal end of the second link, and the second link including a bifurcated lift plate integrally mounted to a forward end of the second link, and wherein the top support leg includes a support boss integrally mounted to a bottom surface of the top support leg adjacent each terminal end of the top support leg, and each support boss defining a predetermined length therebetween, and the predetermined length substantially equal to or greater than a further predetermined length defined by the bottom support leg to permit reception and alignment of the bottom support leg to the top support leg between each support boss, and wherein the first link includes a series of first link apertures, and the second link includes a second link pivot axle selectively receivable within one of the first link apertures to pivotally mount the second link relative to the first link with the second link pivot axle integrally and orthogonally mounted to the second link adjacent the rear terminal end of the second link, and wherein the bifurcated lift plate includes a bottom plate fixedly mounted orthogonally to the forward terminal end of the second link and a top plate integrally mounted at an obtuse angle to the bottom plate to direct the top plate rearwardly of the bottom plate with a plurality of spaced legs defined by the top plate with the spaced legs mounted to a top portion of the top plate spaced from the bottom plate, and including an abutment plate mounted to the support post adjacent the upper terminal end of the support post, and including a "U" shaped spring clip fixedly mounted to a forward surface of the support post underlying the abutment plate and spaced above the bottom terminal end of the support post, and a lifting jack selectively securable within the "U" shaped spring clip to permit selective removal of the lifting jack relative to the support post.

2. Apparatus as set forth in claim 1 including a first, second, and third support sleeve mounted to respective right side, rear side, and left side of the support post, the first, second, and third support sleeve each including a respective hinge to hingedly mount each support sleeve to the support post, and each support sleeve including a respective first, second, and third stabilizer rod telescopingly receivable within each support sleeve, and each support sleeve including a clamp to selectively secure each stabilizer rod in a relative position relative to each support sleeve.

* * * * *